US010385607B2

(12) United States Patent
Franck

(10) Patent No.: US 10,385,607 B2
(45) Date of Patent: Aug. 20, 2019

(54) FIXED GLAZING

(71) Applicant: Jan Franck, Weidenberg (DE)

(72) Inventor: Jan Franck, Weidenberg (DE)

( * ) Notice: Subject to any disclaimer, the term of this patent is extended or adjusted under 35 U.S.C. 154(b) by 0 days.

(21) Appl. No.: 15/307,264

(22) PCT Filed: Apr. 28, 2015

(86) PCT No.: PCT/IB2015/000587
§ 371 (c)(1),
(2) Date: Oct. 27, 2016

(87) PCT Pub. No.: WO2015/166328
PCT Pub. Date: Nov. 5, 2015

(65) Prior Publication Data

US 2017/0152700 A1 Jun. 1, 2017

(30) Foreign Application Priority Data

Apr. 28, 2014 (DE) ..... 10 2014 005 989

(51) Int. Cl.

| | |
|---|---|
| ***E04D 3/06*** | (2006.01) |
| ***E06B 3/56*** | (2006.01) |
| ***E06B 3/02*** | (2006.01) |
| ***E06B 3/66*** | (2006.01) |
| ***E04D 13/03*** | (2006.01) |
| ***E06B 1/02*** | (2006.01) |
| ***E06B 3/54*** | (2006.01) |
| *E04D 5/10* | (2006.01) |

(52) U.S. Cl.
CPC ..... *E06B 3/56* (2013.01); *E04D 13/03* (2013.01); *E06B 1/02* (2013.01); *E06B 3/025* (2013.01); *E06B 3/5427* (2013.01); *E06B 3/6617* (2013.01); *E06B 3/6621* (2013.01); *E04D 5/10* (2013.01)

(58) Field of Classification Search
CPC ... E04D 3/06; E04D 2003/0831; E04D 13/03; B32B 17/10045; B60J 10/00; E04B 5/46; E06B 1/02; E06B 3/56
USPC ..... 52/208
See application file for complete search history.

(56) References Cited

U.S. PATENT DOCUMENTS

| | | | | |
|---|---|---|---|---|
| 2,030,718 A * | 2/1936 | Richards | E04B 5/46 | 404/24 |
| 2,253,527 A * | 8/1941 | Ohlis | E04B 5/46 | 52/200 |
| 3,426,493 A * | 2/1969 | Aspaas | E04B 2/92 | 52/204.591 |
| 3,791,074 A * | 2/1974 | Waffenschmidt | E05D 15/52 | 16/242 |

(Continued)

FOREIGN PATENT DOCUMENTS

| | | |
|---|---|---|
| DE | 9101799 | 7/1991 |
| DE | 20209867 | 11/2002 |

(Continued)

*Primary Examiner* — Brian E Glessner
*Assistant Examiner* — Daniel J Kenny
(74) *Attorney, Agent, or Firm* — Pandiscio & Pandisico

(57) ABSTRACT

The invention relates to fixed glazing for a building, comprising at least one glass pane, for example triple glazing. According to the invention, the glass pane is directly inserted in the adjacent building structure without interposing a frame that consists of a rigid material, and/or it is inserted in the laterally adjacent insulation of the building structure.

10 Claims, 1 Drawing Sheet

(56) References Cited

U.S. PATENT DOCUMENTS

| | | | | | |
|---|---|---|---|---|---|
| 3,846,948 | A * | 11/1974 | Dallen | E06B 3/5409 | 52/204.597 |
| 4,046,933 | A * | 9/1977 | Stefanik | B32B 3/02 | 156/107 |
| 4,598,525 | A * | 7/1986 | Poore | E06B 3/6205 | 52/204.705 |
| 4,999,964 | A * | 3/1991 | Taylor | E04B 5/46 | 52/477 |
| 5,205,095 | A * | 4/1993 | Kessler | E06B 3/56 | 296/201 |
| 5,533,314 | A * | 7/1996 | Kunert | B32B 3/10 | 156/109 |
| 7,469,509 | B2 * | 12/2008 | Cripe | E06B 3/5481 | 296/146.15 |
| 8,024,898 | B2 * | 9/2011 | Alvarado | E06B 1/02 | 52/204.1 |
| 2009/0151255 | A1 * | 6/2009 | Haak | E06B 5/11 | 49/9 |
| 2012/0151857 | A1 * | 6/2012 | Heikkila | E06B 3/66366 | 52/204.593 |

FOREIGN PATENT DOCUMENTS

| | | |
|---|---|---|
| DE | 102013000033 | 7/2013 |
| LU | 69024 | 8/1975 |
| LU | 69848 | 3/1976 |

* cited by examiner

FIXED GLAZING

REFERENCE TO PENDING PRIOR PATENT APPLICATIONS

This patent application claims benefit of International (PCT) Patent Application No. PCT/IB2015/000587, filed 28 Apr. 2015 by Jan Franck for FIXED GLAZING, which claims benefit of German Patent Application No. DE 10 2014 005 989.8, filed 28 Apr. 2014, which patent applications are hereby incorporated herein by reference.

FIELD OF THE INVENTION

The invention is directed to a fixed glazing for a building, comprising a glass pane, for example, a triple glazing.

BACKGROUND OF THE INVENTION

Glass panes are typically framed in a frame—for example, made of plastic, wood, or metal—and inserted together with the frame into the relevant building structure, anchored, sealed, and finally plastered in. This procedure is not only very complex; in addition, the frame can represent a type of thermal bridge in relation to a high-quality glazing.

SUMMARY OF THE INVENTION

The problem which initiates the invention results from the described disadvantages of the previously known prior art, of refining a fixed glazing of the type in question such that thermal bridges are avoided as much as possible and/or so that the installation is to be implemented with the least possible expenditure.

This problem is solved in that the glass pane is directly inserted into the adjacent building structure, without interposing a frame that consists of rigid material, and/or it is inserted into the laterally adjacent installation of the building structure.

By avoiding a frame, the risk of forming a thermal bridge is reduced. A further reduction is possible in that the glass pane is directly adjacent to the lateral insulation, i.e., is not displaced away from it into the building shell. The latter is made possible in particular in that a loadbearing insulation is used in any case in the region of the surroundings of the relevant fixed glazing, in particular extruded polystyrene (XPS, frequently also used as so-called perimeter insulation). This insulation is fixedly anchored on the building shell, for example, by gluing. A channel is preferably incorporated into this loadbearing insulation along the visible inner edge, the depth of which approximately corresponds to the thickness of the relevant glass pane. After the glass pane has been inserted into this channel, it is fixed therein, for example, by casting a liquid, curing plastic, for example, a casting resin, or a curing, mineral substance, for example, soluble glass, in the remaining gap.

In that the glass pane is inserted into a circumferential channel of the adjacent building structure, in particular thermal insulation, it can be at least partially enclosed and guided in a supporting manner thereby.

The glass pane is to consist of two or preferably three layers, of which the outermost one is somewhat smaller than the other(s), so that the inner layer(s) extend(s) into a channel of the adjoining building structure, in particular thermal insulation, but the outermost layer, in contrast, can slide on the inner edge of the part having the channel.

The invention suggests that the glass pane have a circumferential tape be stuck onto its edge. In this case, this is a protection for the particularly endangered edge region of a pane, on the one hand, from which cracks very frequently originate; on the other hand, the enclosing structure can optimally be adjacent to a tape having a comparatively rough surface composition, so that the formation of cracks along the joint between glass pane and building structure is reduced.

The invention may be refined in that the glass pane is sealed or fixed on the enclosing building structure, for example, by a curing artificial resin, in particular casting resin, or by a curing mineral substance, in particular soluble glass. The occurrence of leaks and therefore the penetration of water or the like is thus counteracted.

Finally, it corresponds to the teaching of the invention that a flexible film material, for example, made of ethylene-propylene-diene rubber (EPDM) is preferably drawn over the glass pane on the outer side and glued thereon. In particular in the roof region, a flexible film roof material, for example, ethylene-propylene-diene rubber (EPDM) can be drawn over the edge of the glass pane and glued thereon.

BRIEF DESCRIPTION OF THE DRAWINGS

Further features, details, advantages, and effects on the basis of the invention result from the following description of several preferred embodiments of the invention and on the basis of the drawing. In the figures:

FIG. 1 shows a section transversely through a fixed glazing according to the invention, which is also suitable in particular for vertical glazings on walls or the like; and FIG. 2 shows a section transversely through a fixed glazing according to the invention, which is particularly suitable for horizontal glazings on roofs or the like.

DETAILED DESCRIPTION OF THE PREFERRED EMBODIMENTS

In both figures, one glass pane 1; 1' having three layers 2; 2' is used in each case. Two layers 2 thereof are each of equal size; the third, outermost layer is somewhat smaller, so that a circumferential channel 3; 3' results, having approximately one-third the depth of the entire glass pane 1. The glass pane 1; 1' can have a circumferential tape stuck onto its edge, which protects the glass pane 1; 1' itself during the installation and additionally provides an optimum surface composition for an attachment to an enclosing building structure 4; 4'.

Figure 1:
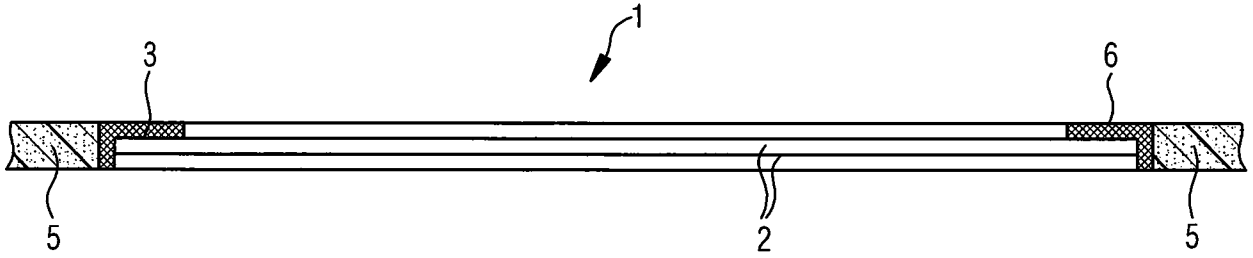

In the installation variant 1 according to FIG. 1, such a glass pane 1 is inserted abutting into a corresponding recess, in particular in the region of a thermal insulation 5, for example, made of XPS plates. A film 6 can be inserted in between, for example, an EPDM film, for example, having a tab which engages in the channel of the glass pane in the region of its outermost layer. These EPDM film 6 can be glued to the glass pane 1. This installation method is particularly suitable for vertical glazings in walls, because the glass pane 1 is then seated with its lower edge on the reveal of the relevant wall or insulation recess and the weight force of the glass pane 1 is thus completely absorbed.

Figure 2:
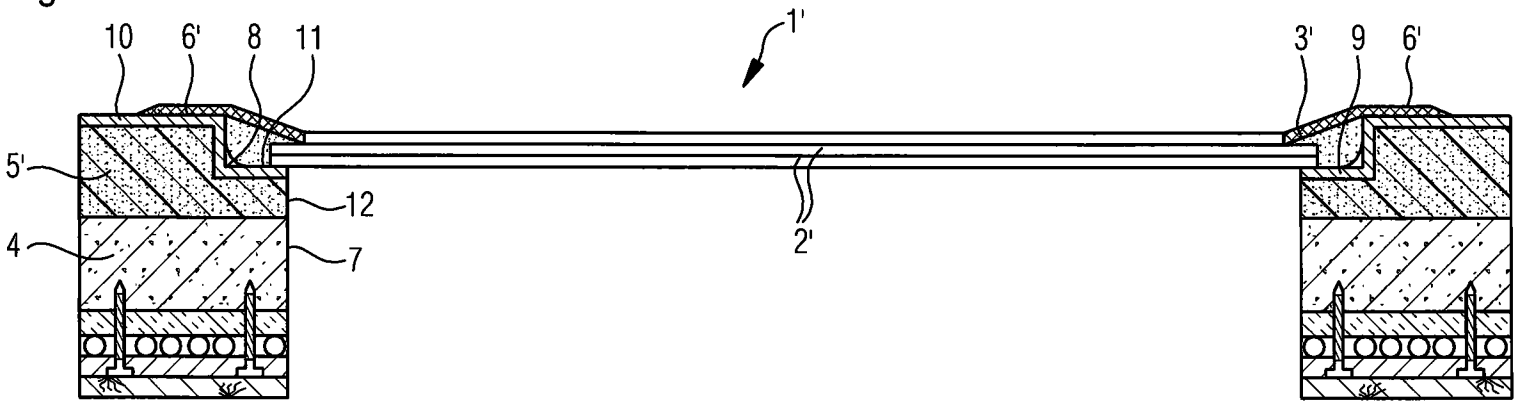

In the installation variant 2 according to FIG. 2, a channel 8, which corresponds approximately to the thickness of the glass pane 1', and which extends along the edge facing toward the recess 7 in the building structure, is incorporated in the insulation 5', which preferably consists of XPS or a comparable stable material. The glass pane 1' is inserted therein.

This is preferably a roof glazing, so that the planar lower side 9 of the channel 8 engages below the glass pane 1' along its edge and the weight of the glass pane 1' is thus absorbed.

A film 10, which forms the actual roof cladding, for example, made of EPDM, is preferably first folded and/or bent into the channel 8, so that it is located in the region of the channel 8 between the glass pane 1' and the thermal insulation 5' and ensures a first seal therein.

A possibly remaining gap between the circumference of the glass pane 1' and the channel 8 in thermal insulation 5', can have, for example, a liquid plastic or another sealant or grouting material 11, which is preferably suitable for the outside, cast therein. An elastic material is preferable in this case, which is capable of, for example, compensating for thermally-related relative expansions between glass pane 1' and reveal and/or thermal insulation 5'.

Finally, an EPDM film 6' or the like can be spread over the edge of the glass pane 1, in particular such that it plunges into the channel 3' of the glass pane 1' adjacent to the outermost layer 2' thereof. An optimum seal can thus be achieved, in particular if the EPDM film 6' is fixed by means of adhesive along the edge of the glass pane 1'.

LIST OF REFERENCE NUMERALS

1 glass pane
2 layer
3 channel
4 building structure
5 thermal insulation
6 film
7 recess
8 channel
9 lower side
10 film
11 grouting material
12 edge

The invention claimed is:

1. A combined building system comprising in combination:

a building structure;

a thermal insulation in the form of plates fixed at least partially on the outside of the building structure; and a fixed glazing inserted in the thermal insulation, the fixed glazing comprising at least one glass pane, wherein the at least one glass pane is inserted into a circumferential channel of an adjacent portion of the thermal insulation, wherein no rigid frame is interposed between the surrounding channel of the thermal insulation plates and the fixed glazing is inserted in the insulation.

2. The combined building system according to claim 1, comprising a glass pane, characterized in that the glass pane is located flush and/or in a shared plane with the laterally adjacent thermal insulation of the building structure.

3. The combined building system as in claim 2, characterized in that the glazing is a triple glazing having three glass layers connected to one another.

4. The combined building system as in claim 1, characterized in that the at least one glass pane has a circumferential tape stuck onto its edge.

5. The combined building system as in claim 1, characterized in that the at least one glass pane is sealed or fixed on the surrounding thermal insulation, or is sealed or fixed on the surrounding thermal insulation by a curing artificial resin, or by a casting resin, or by a curing mineral substance, or by a soluble glass.

6. The combined building system as in claim 1, characterized in that a flexible film material, or a flexible film material made of ethylene-propylene-diene rubber (EPDM), partially extends over the at least one glass pane and is glued thereon.

7. A combined building system comprising in combination:

a building structure;

a thermal insulation in the form of plates fixed at least partially on the outside of the building structure; and a fixed glazing comprising two or three glass pane layers inserted in the thermal insulation, wherein the glass pane layers are is directly inserted into a channel of a laterally adjacent portion of the thermal insulation, wherein no rigid frame is interposed between the thermal insulation channel and the fixed glazing, and wherein the an outermost pane layer is smaller than the other pane layer or layers, wherein an inner layer or layers extend (s) into the channel of the thermal insulation, and the outermost layer terminates proximate an inner edge of the thermal insulation having the channel, and wherein a flexible film material is spread over the edge of the glass pane such that it plunges into the glazing adjacent the outermost layer thereof.

8. The combined building system as in claim 7, characterized in that the glass panes have a circumferential tape stuck onto its edge.

9. The combined building system as in claim 7, characterized in that the glass panes are sealed or fixed on the surrounding thermal insulation of the building structure, or is sealed or fixed on the surrounding thermal insulation of the building structure by a curing artificial resin, or by a casting resin, or by a curing mineral substance, or by a soluble glass.

10. The combined building system as in claim 7, characterized in that the flexible film material is made of ethylene-propylene-diene rubber (EPDM).

* * * * *